US006547896B2

(12) United States Patent
Uggowitzer et al.

(10) Patent No.: US 6,547,896 B2
(45) Date of Patent: Apr. 15, 2003

(54) PROCESS FOR THE PRODUCTION OF A MATERIAL MADE OF A METAL ALLOY

(75) Inventors: Peter J. Uggowitzer, Ottenbach (CH); Gian-Carlo Gullo, Zurich (CH); Markus O. Speidel, Birmenstorf (CH); Kurt Steinhoff, Burglen (CH)

(73) Assignee: Ruag Munition, Thun (CH)

( * ) Notice: Subject to any disclaimer, the term of this patent is extended or adjusted under 35 U.S.C. 154(b) by 0 days.

(21) Appl. No.: 09/818,393

(22) Filed: Mar. 27, 2001

(65) Prior Publication Data

US 2001/0027833 A1 Oct. 11, 2001

Related U.S. Application Data

(63) Continuation of application No. PCT/CH00/00391, filed on Jul. 19, 2000.

(30) Foreign Application Priority Data

Jul. 28, 1999 (EP) ..... 99810683

(51) Int. Cl.[7] ..... C22C 21/08; B22D 21/04
(52) U.S. Cl. ..... 148/549
(58) Field of Search ..... 420/590, 528; 148/549

(56) References Cited

U.S. PATENT DOCUMENTS 5,879,478 A 3/1999 Loue et al.

FOREIGN PATENT DOCUMENTS

| | | |
|---|---|---|
| EP | 0 090 253 A2 | 10/1983 |
| EP | 0 554 808 A1 | 8/1993 |
| EP | 0 745 694 A1 | 12/1996 |
| EP | 0 765 945 A1 | 4/1997 |
| EP | 0 773 302 A1 | 5/1997 |
| EP | 0 792 380 B1 | 9/1997 |
| WO | WO 87/06957 A1 | 11/1987 |

*Primary Examiner*—Roy King
*Assistant Examiner*—Harry D. Wilkins, III
(74) *Attorney, Agent, or Firm*—Schweitzer Cornman Gross & Bondell LLP

(57) ABSTRACT

A process for the production of a material made of a metal alloy for subsequent forming of the material in the semi-solid state, provides that the metal alloy (X) is brought to a starting temperature that is above the liquidus. An additive is added which is capable of reducing an interfacial surface energy between the solid phase and the liquid phase after the metal alloy has been mixed with the additive and transformed into the semi-solid state. The volume fraction of the additive (Z) is selected in such a way that, in the semi-solid material at a liquid phase fraction ($f^L$) of 15% to 75%, the grain size (D) and the degree of skeletization ($f^S C^S$) during a holding time (t) of more than 15 minutes remain essentially constant in order to retain the formability of a suspension.

4 Claims, 3 Drawing Sheets

PROCESS FOR THE PRODUCTION OF A MATERIAL MADE OF A METAL ALLOY

This application is a continuation of PCT/CH00/00391, filed Jul. 19, 2000.

The invention relates to a process for the production of a metal alloy material capable of thixotropic forming.

BACKGROUND OF THE INVENTION

The forming of metal alloys in the semi-solid state by means of thixocasting, thixoforging or thixopressure injection is gaining significance as an alternative to the classic methods for producing formed pieces by means of casting, forging and pressure injection. Thus, it is now possible to start with a material in the semi-liquid/semi-solid state—hereunder designated as semi-solid—to manufacture cast or forged structural components that meet high quality demands. Particularly when it comes to the production of heavy-duty, lightweight metal formed pieces with a complex geometry, forming in the semi-solid state offers great economic advantages. Thus, for example, the forming of aluminum or magnesium alloys in the semi-solid state is a hybrid process that combines the great design freedom and manufacturing speed of die casting processes with the quality advantages of forging processes.

The prerequisite for successful production by forming a material such as a metal alloy, in the semi-solid state is a special thixotropic behavior on the part of the material whereby the use of the term "thixotropy" refers to a thixotropic behavior in which mechanical stress due to shear stress leads to a substantial decrease in the material's viscosity. It should be kept in mind that the viscosity under load changes by several orders of magnitude. Thus, for example, when a thixotropic metal alloy is in the unstressed state, its viscosity is about $10^6$ to $10^9$ Pas, which corresponds to the properties of a solid, whereas under shear stress, the viscosity drops to values of about 1 Pas, which corresponds to a viscosity between that of honey (10 Pas) and that of olive oil ($10^{-1}$ Pas).

It is known that, when a thixotropic material is in the unstressed state, the geometrical configuration of the solid phase is characterized by coherent grain groupings, which form a spatial skeleton When a shear stress is applied, these superstructures are broken apart, giving rise to a flowable suspension consisting of solid particles in a liquid matrix phase, hereunder designated as a "solid-liquid suspension". Accordingly, the semi-solid state of a material is a necessary but not yet sufficient condition for thixotropic behavior. On the contrary, the decisive aspect is a special configuration of the microstructure in which the above-mentioned spatial skeleton can be broken apart under shear stress. This condition cannot be met by all materials, first of all because the melt interval has to be sufficiently wide and secondly, because a special pretreatment is needed so that the structure of the solid phase does not become dendritic but rather globular.

The formation of a thixotropic fine structure is described, among other places, in EP 0090253 A, EP 0554808 A, EP 0745694 A, EP 0765945 A and EP 0792380 B1. A distinction is made essentially between the two process variants of conventional thixocasting (CTC) and new rheocasting (NRC). In the CTC process, a material that is usually made by means of stirred strand casting is inductively heated in portioned sections in the semi-solid state and subsequently, in a die casting machine, is transformed into a solid-liquid suspension that is pressure injected into a mold. With the NRC process, the globular material is made by a controlled cooling off of a melt in the semi-solid state that has been metered into steel crucibles.

Regardless of whether the semi-solid state of a material is achieved by heating a solid phase as is done in the CTC process or by cooling off the melt as is done in the NRC process, a decisive criterion as to whether a material can be transformed into a low-viscosity, solid-liquid suspension is the already mentioned globular structural evolution. The latter can be described essentially by four structural parameters, whereby it is advantageous to use the solid phase fraction, the form factor of the solid phase, the grain size of the solid phase and the degree of skeletization. Limit values for said structural parameters are only partially known from the state of the art.

EP 0554808 A, describes a process of the generic type for the production of a material made of a metal-alloy for a subsequent forming of the material in the semi-solid state. According to this teaching, the metal alloy is brought to a starting temperature that is above the liquidus and then a grain refiner is added to the melt thus formed. Subsequently, the metal alloy is cooled off to any temperature below the solidus and material thus formed is kept in the solid state essentially for any desired time. Finally, the material is brought into the semi-solid state by being heated up to a holding temperature that lies between the solidus and the liquidus, and is kept there for a holding time of less than 15 minutes. The forming of the material in the semi-solid state absolutely has to be carried out within the less than 15 minute holding time.

A drawback of such a process is that, since the holding time is limited to less than 15 minutes, the materials made by the process are not suitable for use in conventional forming installations. Consequently, processing by means of thixocasting, thixoforging or thixopressure injection of the materials made by means of the known process calls for the special production installations capable of ensuring that the forming is carried out within the processing window that is limited to less than 15 minutes. Another disadvantage of the process lies in the fact that the material first has to be cooled off from the molten state to the solid state and only then can it be brought into the semi-solid state for subsequent forming. This interim solidification is extremely undesirable, especially for an automated production and forming process.

BRIEF DESCRIPTION OF THE INVENTION

An objective of the present invention is to provide an improved thixotropic process In the process according to the invention for the production of a material made of a metal alloy for subsequent forming of the material in the semi-solid state, the metal alloy is brought to a starting temperature that is above the liquidus and then an additive is added which is capable of reducing an interfacial surface energy between the solid phase and the liquid phase after the metal alloy has been mixed with the additive and transformed into the semi-solid state. The volume fraction of the additive is selected such that, in the semi-solid material at a solid phase fraction of 25% to 85%, the grain size and the degree of skeletization during a holding time of more than 15 minutes both remain essentially constant in order to retain the formability of a suspension.

Since the grain size and the degree of skeletization remain essentially constant during a holding time of more than 15 minutes, a phlegmatization of the semi-solid material is achieved which allows a more advantageous production from both economic and environmental standpoints. The prolongation of the processing window leads to a reduction in rejects that are inevitably created with the prior art process whenever the thixotropic properties of the material are lost because the holding time is too long. Moreover, when the process according to the invention is used, thanks to the phlegmatization that can be achieved, the transformation of the material into the semi-solid state for the subsequent forming can be carried out directly from the melt, i.e. an interim solidification of the material is not necessary. In this manner, the acquisition of costly special production installations can be avoided or at least limited, and the ability arises for a far-reaching process integration of material production and subsequent forming. Moreover, the process sequence can be largely homogenized, even in existing production installations, as a result of the reduced structural sensitivity. If storage of the material is desired, it can be cooled off to a storage temperature that lies below the solidus and restored to the semi-solid state just before forming, without the advantageous phlegmatization being lost.

Using the material made with the process according to the invention, structural components can be made by a subsequent forming procedure that exhibit a good combination of strength and toughness, that can also be heat-treated and welded, and that are pressure-proof and relatively inexpensive.

The process can be used with various types of metal alloys. In a preferred embodiment, the metal alloy contains aluminum as the main component and barium is used as the additive, whereby the weight fraction of the barium may be 0.1% to 0.8% of the material. In view of the enormous importance of aluminum structural components, the advantages of such an embodiment is clear.

Especially good results are achieved when a dispersoid-forming element is added to the metal alloy in order to promote the formation of grains having a small grain size. In the case of aluminum alloys, iron, chromium, titanium, or zirconium is advantageously used as the dispersoid-forming element. The weight fraction of the dispersoid-forming element can be between 0.1% and 1% of the material.

BRIEF DESCRIPTION OF THE DRAWINGS

A fuller understanding of the invention will be accomplished upon consideration of the following, with reference to the drawings, in which.

DETAILED DESCRIPTION OF THE INVENTION

1. Principles

Figure 1:
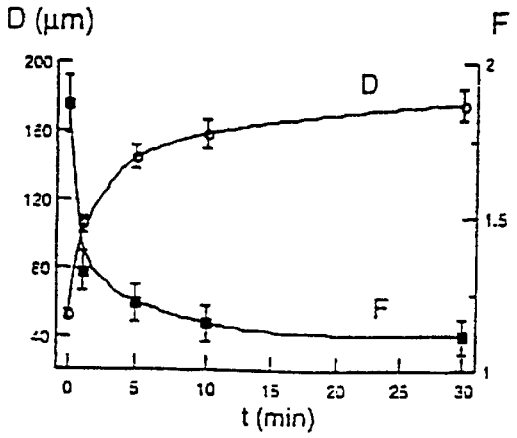
FIG. 1 is a plot of mean grain size D and form factor F for an aluminum alloy produced according to the state of the art (EN AW-6082, hereunder designated as: "aluminum alloy X") with a constant liquid phase fraction of 35%, as a function of the isothermal holding time.

As stated above, thixotropy refers to a special rheologic behavior in which a mechanical load due to shear stress leads to a considerable decrease in the viscosity. Thixotropic behavior can be expected with materials in the semi-solid state, i.e. at a temperature that lies between the solidus line and liquidus line, when the semi-solid material can be transformed into a low-viscosity suspension under shear stress. This formability of a suspension presupposes a special structural evolution in the semi-solid state at which the solid components are not dendritic but rather globular.

The structural evolution can be described by four structural parameters, namely, by the solid phase fraction $f^S$, the form factor of the solid phase F, the grain size of the solid phase D and the degree of skeletization, whereby the latter is expressed either by the measured quantity $C^S$, designated as contiguity, or preferably by the contiguity volume $f^S C^S$. Instead of the solid phase fraction, the liquid phase fraction $f^L$ can also be specified, whereby the quantities $f^L$ and $f^S$ add up to 1 and gaseous phase fractions are ignored, which is permissible in this case.

Although no precise limit values for thixotropic behavior are indicated in the art for the solid phase fraction, it is assumed that the solid phase fraction should be about 40% to 60%. In addition to the solid or liquid phase fraction, the morphology and the connectivity of the solid phase are the process-determining characteristic quantities of the structure. A quantitative description of the structural morphology can be made using the form factor F and the grain size D. The form factor F is defined as $$F = \frac{U^2}{4\pi A}$$

wherein U is the mean grain circumference and A is the mean projected grain surface area. F>1 if the grains have a complex shaped surface and F=1 if all of the grains are spherical. (It should be pointed out that, in some places, the form factor is used as a reciprocal size of the defined form factor in question, but this can readily be seen from the individual circumstances.) To a great extent, the form factor determines the viscosity of the solid-liquid suspension, whereby, for a sufficient formability of the material, an upper limit for the form factor must not be exceeded. Nowadays, this boundary condition is generally met quite well by CTC and by NRC materials.

Although no generally valid upper limit value is given in the art for the grain size D, experience has shown that, when thin structural parts are formed, a grain size of about one-twentieth of the wall thickness of the structural part should not be exceeded. Thus, for a wall thickness of 3 mm, another criterion to be observed is a maximum grain size of about 150 $\mu$m.

2. Characterization of Materials in the Semi-solid State

A commercially available thixoalloy of the AlMgSi type (hereunder designated as "aluminum alloy X") with a composition similar to the alloy with the designation EN AW-6082 according to European standard EN 573-3, namely with a chemical composition of 1.1% by weight of silicon, 0.85% by weight of magnesium, 0.61% by weight of manganese, 0.09% by weight of iron, 0.08% by weight of titanium, <0.01% by weight of chromium, <0.01% by weight of copper, <0.01% by weight of nickel, <0.01% by weight of lead and <0.01% by weight of zinc was heated up in an infrared furnace to a desired temperature within the solidus-liquidus interval at a rate of 100° C. [180° F.] per minute, isothermally homogenized and subsequently quenched. So as to be able to quench the test specimens as quickly as possible, the infrared tubular furnace is positioned above a tank filled with ice water. The installation is constructed in such a way that, after the desired temperature is reached and after homogenization has been carried out, the specimen drops into the water bath when the holder is released. A Pt/PtRh thermoelement attached in the center of gravity of the specimen (15 mm×15 mm×15 mm) ensures a precise temperature measurement (±0.1° C. [0.2° F.]) as well as heat regulation Before each experiment, the thermoelement was checked for accuracy in a calibration furnace. The measurements were limited to the structural evolutions of the microstructure at five selected temperatures in the semi-solid range (613° C. [1135.4° F.], 625° C. [1157° F.], 633° C. [1171.4° F.], 636° C. [1176.8° F.] and 638° C. [1180.4° F.], corresponding to a liquid phase fraction of 10%, 20%, 30%, 35% and 40% respectively) and at isothermal holding times of 1, 5, 10, 20 and 30 minutes.

Subsequent metallographic studies of the quenched specimens show the change of the structure during the re-heating as a function of the test parameters. The characteristic quantities, namely, form factor F, grain size D and contiguity $C^S$ or contiguity volume $f^SC^S$, allow the determination of the structural changes on the basis of the size, shape and spatial interrelationship of the solid a-phase in the liquid matrix.

FIG. 1, shows the change of form factor F and grain size D (in micrometers) as a function of the isothermal holding time t (in minutes) in the semi-solid state at a constant temperature of 636° C. [1176.8° F.], corresponding to a liquid phase fraction $f^L$ of 35%. As the holding time increases, the solid phase is molded and becomes globular, i.e. the form factor F decreases and approaches 1, while at the same time the grain size D increases.

Parallel to the growth of the solid phase, however, its connectivity also increases, i.e. the size of the spatial skeleton. As a measure of the degree of skeletization, i.e. for the contact of adjacent particles of a phase, the contiguity $C^S$ of the solid phase is used, which is defined as $$C^S = \frac{2S^{SS}}{2S^{SS} + S^{SL}}$$

wherein $S^{SS}$ is the grain boundary surface between the solid phase, i.e. the surface between the coherent grains that are not separated by melt, while $S^{SL}$ is the phase boundary surface between the solid phase and the melt. Therefore, the contiguity corresponds to the fraction occupied by the boundary surface to the same phase on the entire boundary surface of the solid phase. If $C^S=0$, the grains are isolated and completely surrounded by melt, whereas as $C^S$ increases, the grains are more strongly coalesced, and accordingly, the skeleton formation is more pronounced. Very low values for $C^S$ are undesirable since then the semi-solid material does not have dimensional stability. Conversely, if $C^S \rightarrow 1$, the solid phase is fully agglomerated and it cannot be transformed into a suspension by applying shear stresses. Correspondingly, an upper limit exists for the contiguity when it comes to the transformation of a material with a coherent solid phase into a solid-liquid suspension. Since the skeleton size depends on the contiguity $C^S$ as well as on the solid phase fraction fs, it is advantageous to select the product $f^SC^S$, that is to say, the contiguity volume, as the determining quantity for the degree of skeletization, a volume which corresponds to the coherent phase areas.

Figure 2:
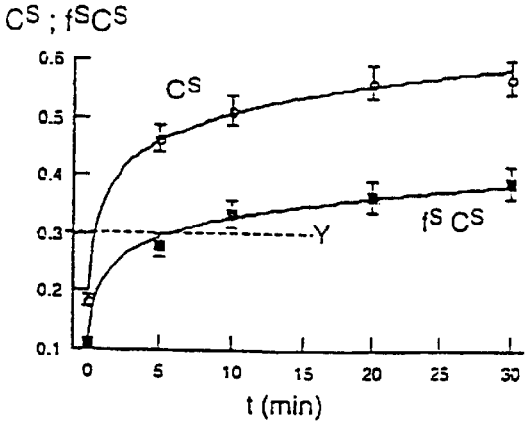
FIG. 2 is a plot of contiguity and contiguity volume of aluminum alloy X at a constant liquid fraction of 35%, as a function of the isothermal holding time.

FIG. 2, shows the change of the contiguity $C^S$ and of the contiguity volume $f^SC^S$ as a function of the holding time t (in minutes) in the semi-solid state at a constant temperature of 636° C. [1176.8° F.], corresponding to a liquid phase fraction $f^L$ of 35%.

Figure 3:
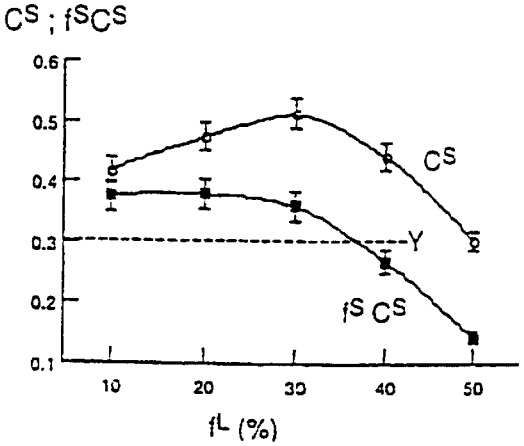
FIG. 3 is a plot of contiguity and contiguity volume of aluminum alloy X as a function of the liquid phase fraction after a constant isothermal holding time of 5 minutes.

FIG. 3, shows the change of the contiguity $C^S$ and of the contiguity volume $f^SC^S$ s after an isothermal holding time of 5 minutes as a function of the liquid phase fraction $f^L$, whereby it should be kept in mind that, if $f^L \rightarrow 1$, then $C^S \rightarrow 0$. The individual values of $C^S$ and $f^SC^S$ are shown for a liquid phase fraction $f^L$ of 10%, 20%, 30% and 40%, corresponding to a temperature of 613° C. [1135.4° F.], 625° C. [1157° F.], 633° C. [1171.4° F.] and 638° C. [1180.4° F.].

As can be seen in FIGS. 2 and 3, the contiguity volume $f^SC^S$ rises with a rising holding time t and drops with an increasing liquid phase fraction $f^L$, whereby as expected, the skeleton formation increases with an increasing holding time t. The properties necessary for a successful forming procedure, however, can only be expected within a certain range of values of the contiguity volume $f^SC^S$. The evaluation given below on the rheologic properties allows a determination of the suitable interval for the contiguity volume $f^SC^S$.

The flow behavior of known alloys was examined by means of a re-extrusion-shaping experiment. For example, using an infrared furnace, a cylindrical specimen (diameter= 26 mm, h=35 mm) of aluminum alloy X was heated in a steel mold at a heating rate of 100° C. [180° F.] per minute to the desired temperature (616° C. [1140.8° F.], 626° C. [1158.8° F.], 633° C. [1171.4° F.], 636° C. [1176.8° F.], 641° C. [1185.8° F.] and 641.5° C. [1186.7° F.], corresponding to a liquid phase fraction $f^L$ of 10%, 20%, 30%, 35%, 40% and 50% respectively). After an isothermal holding time t of 1, 5, 10 and 30 minutes, a forming process was started, whereby the specimen was formed as a billet at a constant billet speed of 200 mm/s. During this process, the displacement l and force K were recorded by means of a computer.

Figure 4:
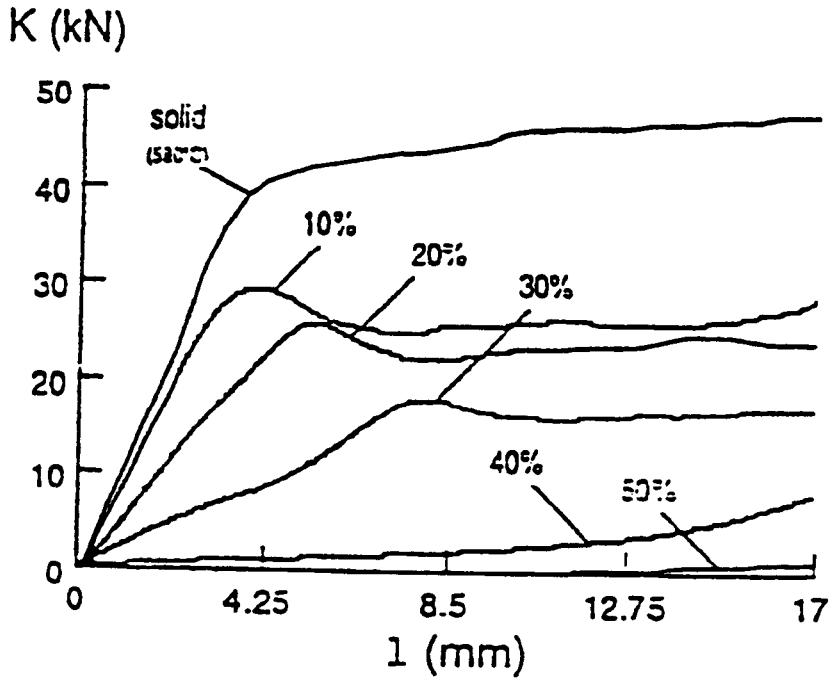
FIG. 4 is a plot of force-displacement curves of aluminum alloy X as a function of the liquid phase fraction after a constant isothermal holding time of 5 minutes.

FIG. 4 shows typical force-displacement curves of aluminum alloy X after an isothermal holding time of 5 minutes at various values of the liquid phase fraction $f^L$, whereby the force K is expressed in kilo-newtons and the displacement l is indicated in millimeters. At a small liquid phase fraction $f^L$ of up to 20%, the force-displacement diagram has a shape that is characteristic of elastic-plastic behavior. In contrast, at a liquid phase fraction $f^L$ of 40% and 50%, the forming forces are very low, thus being in the desired thixotropic range for the process. With a liquid phase fraction $f^L$ of 30%, which lies between the two above-mentioned cases, a transition range from elastic-plastic behavior to thixotropic behavior is found, whereby here the solid phase skeleton is still so large that a low-viscosity suspension cannot be formed. Plastic deformation predominates, but the liquid phase is pressed out of the solid phase mix so that a pronounced phase separation occurs.

Figure 5:
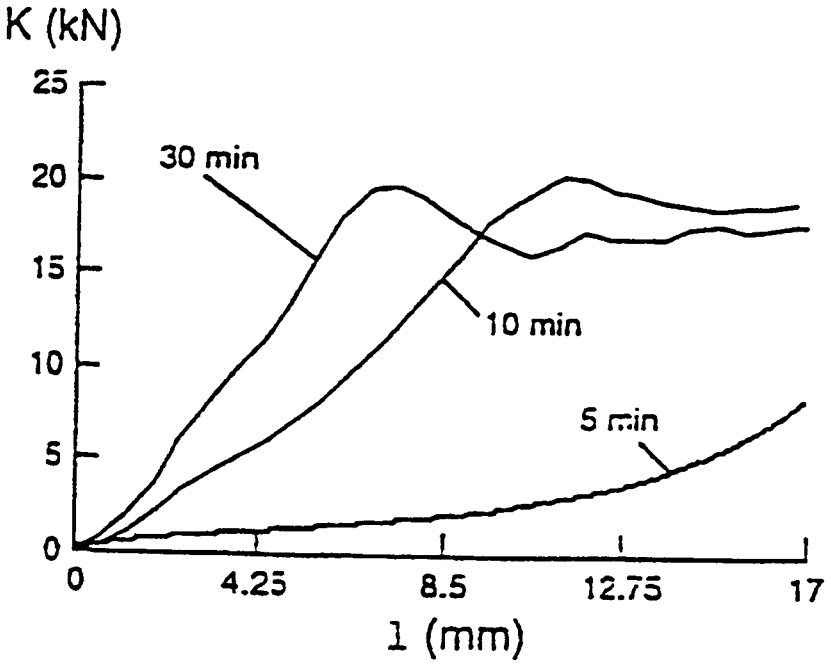
FIG. 5 is a plot of force-displacement curves of aluminum alloy X as a function of the isothermal holding time at a constant liquid phase fraction of 35%.

FIG. 5 shows force-displacement curves after various isothermal holding times t (in minutes) for the same thixoalloy at a liquid phase fraction of 35% (corresponding to a temperature of 636° C. [1176.8° F.]), whereby the force K is expressed in kilo-newton and the displacement l is indicated in millimeters. Whereas thixotropic behavior is still evident after a holding time t of 5 minutes, a longer holding time leads to a loss of the thixotropic properties.

A comparison of FIG. 4 with FIG. 3 shows that the thixotropic behavior observed according to FIG. 4 at a liquid phase fraction $f^L$ of 40% and 50%, when transferred onto FIG. 3, is associated with a decrease in the contiguity volume $f^SC^S$ to values below 0.3. The same conclusion can be reached by comparing FIG. 5 to FIG. 2, whereby the loss of the thixotropic properties that occurs after a holding time t of more than 5 minutes as shown in FIG. 5 is expressed in FIG. 2 as an increase in the contiguity volume $f^SC^S$ to values of more than 0.3.

3. Description of the Process According to the Invention

From the explanation given above, it can be seen that thixotropic behavior, i.e. the ability of the material that is present in the semi-solid state to be transformed into a homogeneous solid-liquid suspension, only exists if the degree of skeletization can be kept sufficiently low, whereby, expressed in numbers, this means that the contiguity volume $f^SC^S$ has to be kept at a value below a critical level of Y=0.3.

This is ensured with the process according to the invention. Surprisingly, it was found that alloying with elements that are capable of reducing interfacial surface energy between the solid phase and the liquid phase makes it possible to keep the grain size D and the degree of skeletization essentially constant within a broad range of the liquid phase fraction $f^L$ from 15% to 75% during a holding time of more than 15 minutes and especially to keep the contiguity volume $f^SC^S$ at a value of less than Y=0.3.

Consequently, it is possible to phlegmatize the material in terms of its thixotropic properties.

In the case of aluminum alloys, examples of additives Z that act in the manner described above are the elements barium, which is especially preferred, as well as antimony, strontium or bismuth. It should be pointed out that, for a few of these elements, especially for silicon, it is known that their addition to an aluminum alloy brings about a positive refinement, for example, through the formation of the aluminum-silicon eutectic. The quantity fractions of these elements used for the refinement, however, lie in the range of a few ppm and in any case, are too low to bring about a phlegmatization of the thixotropic properties. In contrast, the quantity fractions of the additive Z to be used in the process according to the invention are much higher than the quantity fractions of refiners normally used for the modification of a eutectic.

In hindsight, it can be conjectured that the effect achieved with the process according to the invention is based on the fact that, by reducing the interfacial surface energy between the solid phase and the liquid phase of the semi-solid material, there is a reduction in the driving force for the undesired structural changes, comprising especially the grain coarsening and the greater skeletization. The alloying of elements that lower this interfacial surface energy dramatically reduces the speed and therefore also the extent of the structural change that occurs during a certain holding time. The quantity fraction of the additive has to be selected in such a way that the grain size D and the degree of skeletization remain essentially constant during a holding time t of at least 15 minutes. This is illustrated in the embodiment below.

4. Characterization of a Material Made by the Process According to the Invention An amount of 0.2% by weight of barium as additive Z was added to a melt of an aluminum alloy having a composition similar to the alloy with the designation EN AW-6082 according to European standard EN 573-3, by first packaging the necessary amount of barium in aluminum foil and then adding it to the melt. By means of the characterization method described above, the material thus formed (hereunder designated as "aluminum alloy X+Ba") having a chemical composition of 0.2% by weight of barium, 0.8% by weight of silicon, 0.41% by weight of magnesium, 0.28% by weight of manganese, 0.2% by weight of iron, 0.01 % by weight of titanium, 0.19% by weight of chromium, 0.35% by weight of copper, <0.01% by weight of nickel, <0.01% by weight of lead and <0.01% by weight of zinc was heated up in an infrared furnace to a predefined temperature in the solidus-liquidus interval at a rate of 100° C. [180° F.] per minute and subsequently homogenized isothermally. The structural evolution of the microstructure was measured at five selected temperatures in the semi-solid range (618° C. [1144.4° F.], 630° C. [1166° F.], 637° C. [1178.6° F.], 639° C. [1182.2° F.] and 642° C. [1187.6° F.], corresponding to a liquid phase fraction of 10%, 20%, 30%, 35% and 40% respectively) and at isothermal holding times t of 1, 5, 10, 20 and 30 minutes.

Figure 6:
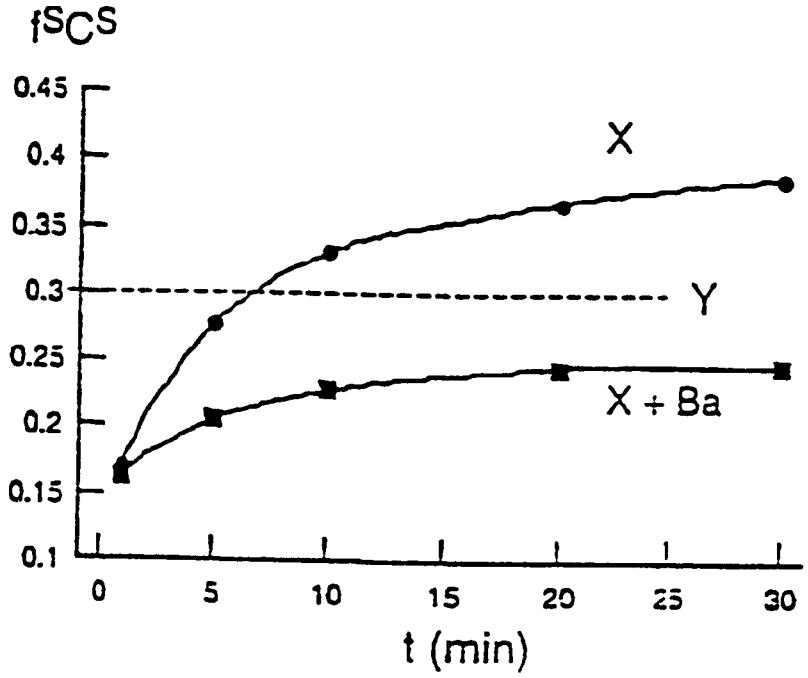
FIG. 6 is a plot of the contiguity volume of aluminum alloy X containing barium (X+Ba) produced according to the invention in comparison to aluminum alloy X, as a function of the isothermal holding time at a constant liquid phase fraction of 35%.

FIG. 6 shows the course of the contiguity volume $f^SC^S$ as a function of the isothermal holding time t (in minutes), on the one hand, at a constant liquid phase fraction $f^L$ of 35% for the material made by means of the process according to the invention, i.e. the aluminum alloy X+Ba and, on the other hand, for the corresponding barium-free alloy X according to the state of the art. By using the process according to the invention, the structural change was significantly reduced. In particular, with the material produced according to the invention, even after a long holding time t of 30 minutes, the critical value Y=0.3 for the contiguity volume $f^SC^S$ was not reached.

Figure 7:
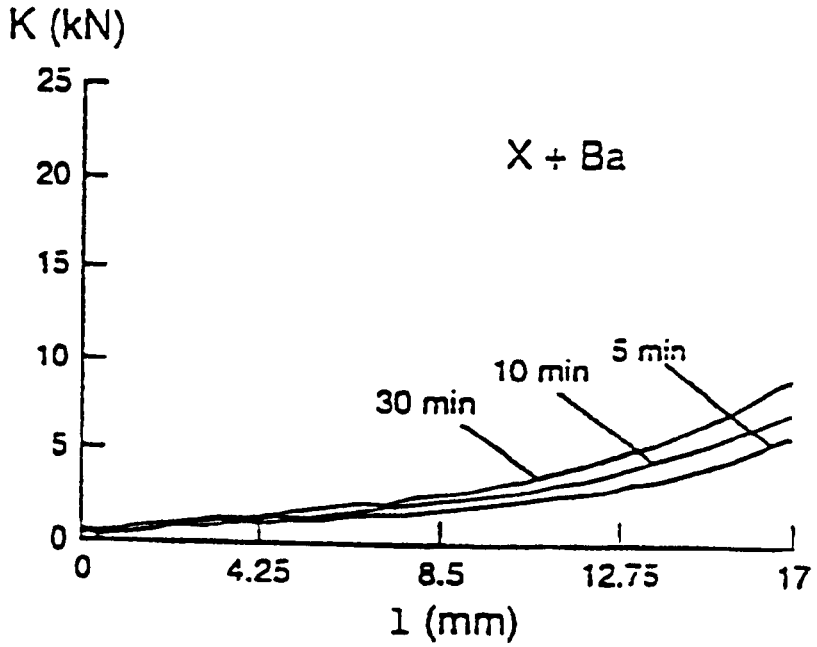
FIG. 7 is a plot of force-displacement curves of aluminum alloy X containing barium (X+Ba) produced according to the invention, as a function of the isothermal holding time at a constant liquid phase fraction of 35%.

As can be seen especially from the force-displacement diagrams (whereby the force K is expressed in kilo-newton and the displacement l is indicated in millimeters) shown in FIG. 7 for the material X+Ba at various holding times t (in minutes), the flow properties of the material hardly change, even after 30 minutes, and they continue to exhibit the characteristic curve for thixotropic behavior. Accordingly, even after a holding time t of 30 minutes, the semi-solid material can be transformed into a homogeneous solid-liquid suspension.

5. Additional Embodiments

The teaching of the present invention as presented above with reference to an aluminum alloy can be used analogously for other metal alloys X, for example, for magnesium alloys, for steels, and heavy metal alloys. One skilled in the art will be able to perform preliminary tests to determine which values of the grain size D and of the degree of skeletization or of the contiguity volume $f^SC^S$ have to be observed in order to retain the formability of a suspension in the semi-solid state and moreover, in order to select a suitable additive Z with properties of reducing the interfacial surface energy for the particular alloy.

The aluminum alloys described in the preceding embodiment having a composition similar to the alloy with the designation EN AW-6082 according to European standard EN 573-3 contain, among other things, an admixture of iron, which acts as a dispersoid-forming element, i.e. in the semi-solid state, it promotes the formation of grains having a small grain size D. When other metal alloys X are used, in addition to the above-mentioned additive Z, if necessary, a suitable dispersoid-forming element E needs to be added.

We claim:

1. A process for the production of a substantially copper-free aluminum metal alloy material for subsequent forming of the material in a semi-solid state, comprising the steps of bringing the metal alloy to a starting temperature that is above the liquidus, adding barium as an additive in an amount of 0.1 to 0.8% by weight of the alloy material to reduce an inter-facial surface energy between a solid phase and a liquid phase of the mixture of the metal alloy and additive when the mixture is transformed into a semi-solid state, with the volume fraction of the additive being selected such that, in the semi-solid state with a liquid phase fraction ($f^L$) of 15% to 75%, a grain size and a degree of skeletization ($f^S C^S$) during a holding time (t) of more than 15 minutes both remain essentially constant, whereby the formability of a suspension is retained.

2. The process according to claim 1, characterized in that a dispersoid-forming element is added to the metal alloy material to promote the formation of grains having a small grain size.

3. The process according to claim 2, characterized in that the dispersoid-forming element is selected from iron, chromium, titanium or zirconium.

4. The process according to claim 3, characterized in that the weight fraction of the dispersoid-forming element is between 0.1% and 1% of the metal alloy material.

* * * * *